US008858175B2

(12) United States Patent
Dutta et al.

(10) Patent No.: US 8,858,175 B2
(45) Date of Patent: Oct. 14, 2014

(54) FILM HOLE TRENCH

(75) Inventors: Sandip Dutta, Greenville, SC (US); Gary Michael Itzel, Simpsonville, SC (US); Benjamin Paul Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 454 days.

(21) Appl. No.: 13/292,432

(22) Filed: Nov. 9, 2011

(65) Prior Publication Data

US 2013/0115103 A1 May 9, 2013

(51) Int. Cl.
*F01D 5/08* (2006.01)
*F01D 5/18* (2006.01)

(52) U.S. Cl.
CPC ..... *F01D 5/186* (2013.01)
USPC ..... 416/97 R

(58) Field of Classification Search
CPC ..... F01D 5/186; F01D 5/187
USPC ..... 416/97 R
See application file for complete search history.

(56) References Cited

U.S. PATENT DOCUMENTS

| | | | | |
|---|---|---|---|---|
| 5,688,104 | A | 11/1997 | Beabout | |
| 6,270,317 | B1 | 8/2001 | Manning et al. | |
| 6,287,075 | B1 | 9/2001 | Kercher | |
| 6,368,060 | B1 | 4/2002 | Fehrenbach et al. | |
| 6,420,677 | B1 * | 7/2002 | Emer et al. | 219/121.71 |
| 7,019,257 | B2 * | 3/2006 | Stevens | 219/121.71 |
| 7,328,580 | B2 | 2/2008 | Lee et al. | |
| 7,374,401 | B2 | 5/2008 | Lee | |
| 7,887,294 | B1 | 2/2011 | Liang | |
| 8,057,179 | B1 * | 11/2011 | Liang | 416/97 R |
| 8,245,519 | B1 * | 8/2012 | Liang | 60/806 |
| 2010/0040459 | A1 * | 2/2010 | Ohkita | 415/177 |
| 2010/0239412 | A1 | 9/2010 | Draper | |

* cited by examiner

*Primary Examiner* — Ninh H Nguyen
(74) *Attorney, Agent, or Firm* — Dority & Manning, P.A.

(57) ABSTRACT

An article is disclosed that comprises a thermal material having a first surface and a second surface. The thermal material defines a film hole between the first surface and the second surface, and the film hole includes a metering portion adjacent the first surface and a diffuser portion adjacent the second surface. The metering portion defines a metering hole axis, and the diffuser portion defines a trench. The trench extends substantially parallel to a metering hole axis.

20 Claims, 4 Drawing Sheets

FIG. —1—

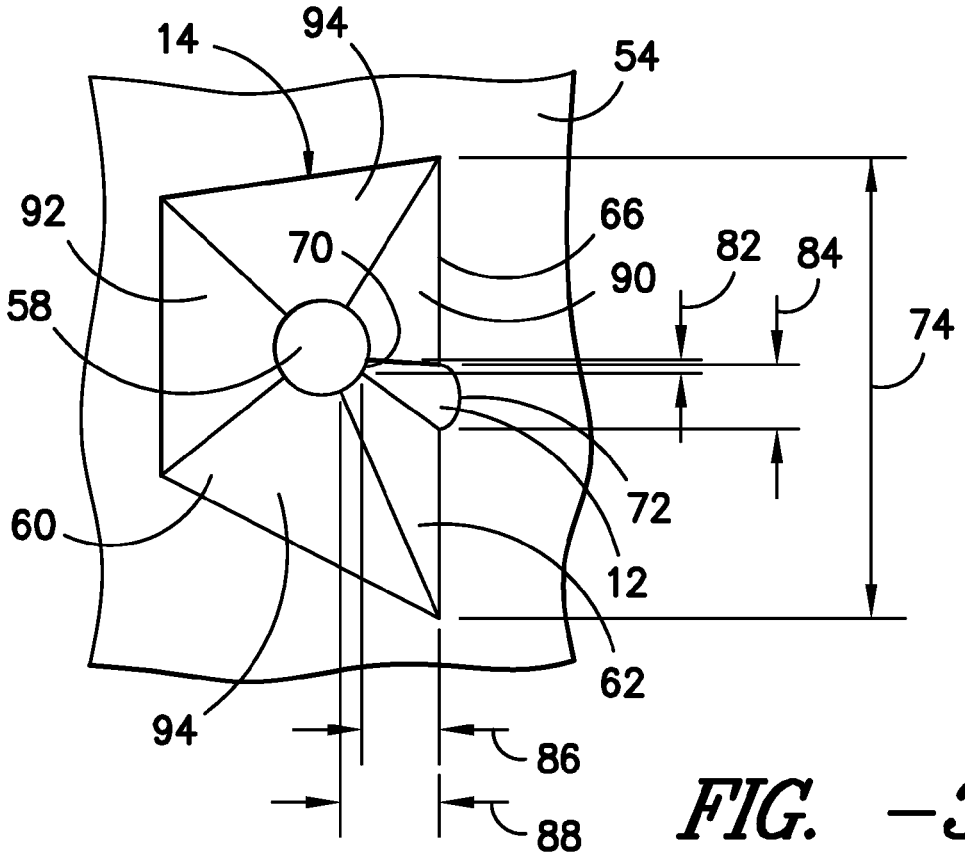
FIG. —3—
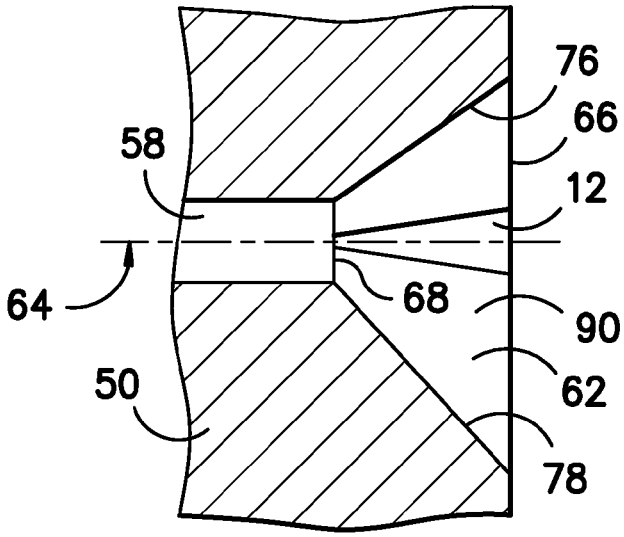
FIG. —4—

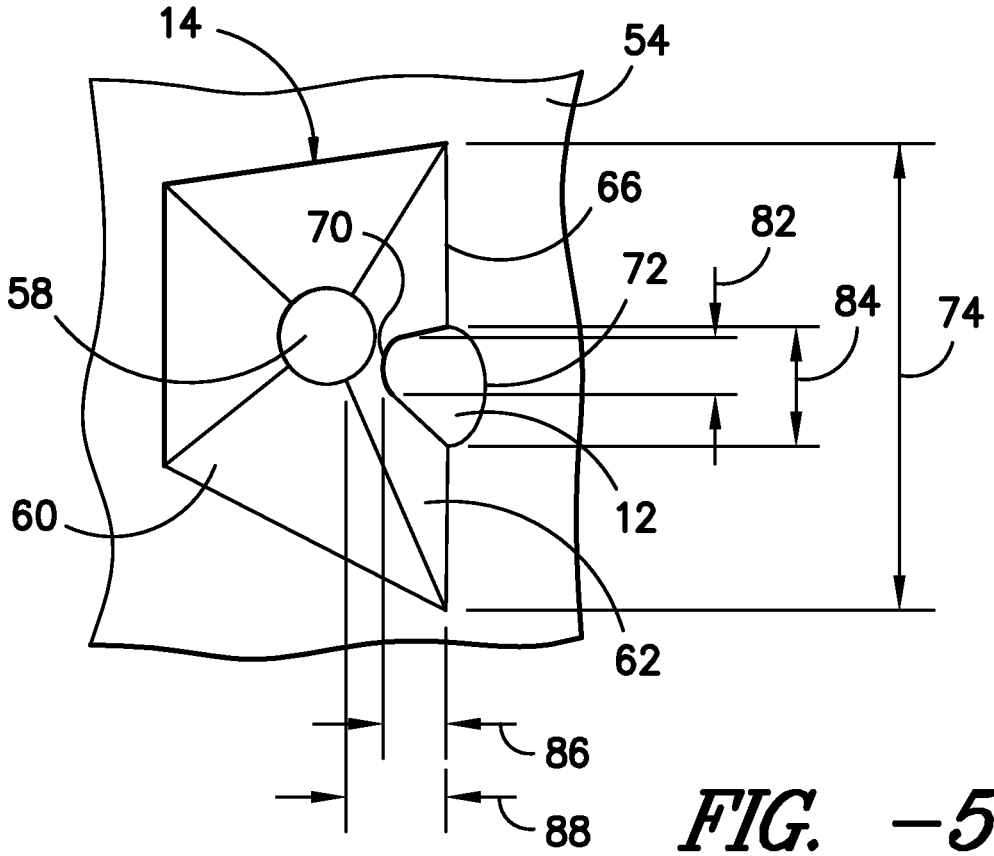
FIG. –5–
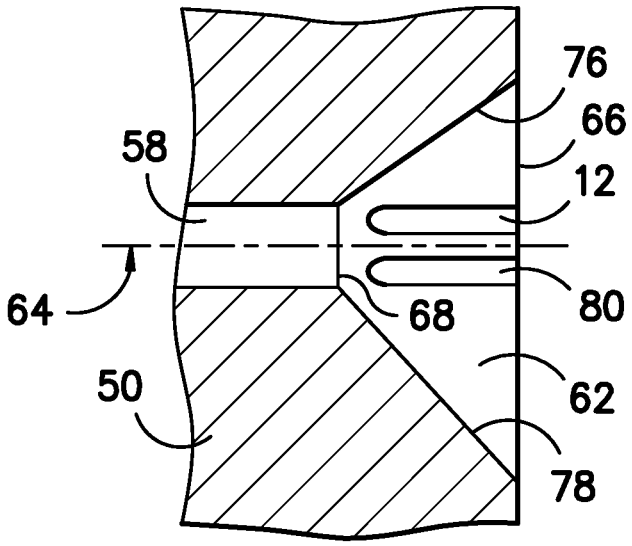
FIG. –6–

FILM HOLE TRENCH

FIELD OF THE INVENTION

The present subject matter relates generally to a film hole trench for an article and, more particularly, to a film hole trench for cooling an airfoil of a gas turbine component.

BACKGROUND OF THE INVENTION

In a gas turbine, hot gases of combustion flow from an annular array of combustors through a transition piece for flow along an annular hot gas path. Turbine stages are typically disposed along the hot gas path such that the hot gases of combustion flow from the transition piece through first-stage nozzles and buckets and through the nozzles and buckets of follow-on turbine stages. The turbine buckets may be secured to a plurality of turbine wheels comprising the turbine rotor, with each turbine wheel being mounted to the rotor shaft for rotation therewith.

A turbine bucket generally includes an airfoil extending radially outwardly from a substantially planar platform and shank portion extending radially inwardly from the platform. The shank portion may include a dovetail or other means to secure the bucket to a turbine wheel of the turbine rotor. In general, during operation of a gas turbine, the hot gases of combustion flowing from the combustors are generally directed over and around the airfoil of the turbine bucket. Thus, to protect the part from high temperatures, the airfoil typically includes an airfoil cooling circuit configured to supply a cooling medium, such as air, to actively cool the airfoil's base material.

Conventionally, the external surfaces of buckets and nozzles of airfoils are cooled using a series of film holes defined through such surfaces. In particular, the film holes are typically drilled on the airfoil surface(s) and into the airfoil cooling circuit to permit the cooling medium flowing through the cooling circuit to be supplied to the airfoil surface. Similar film holes are also used to cool other turbine components (e.g., shrouds). However, it has been found that these film holes often provide for less than optimal cooling of turbine component surfaces. Specifically, since the film holes are drilled straight into the surface, the exit angle of the cooling medium expelled from the holes is relatively high, thereby negatively impacting flow attachment of the cooling medium against the surface. To address such flow attachment issues, various design modifications to the film holes have been proposed, such as by forming advanced-shaped film holes within the surface (e.g., chevron-shaped or bell-shaped holes) or by forming complex-shaped outlets for the film holes. However, many advanced-shaped film holes (e.g., chevron-shaped holes) are designed to spread coolant to the sides of the film hole which may result in non-uniform coolant distribution such as deficient coolant flow through the middle portion of the film hole. In addition, many advanced-shaped film holes such as chevron-shaped film holes create an internal medium flow vortex with a structure that provides insufficient cooling to particular portions of the airfoil.

Accordingly, a cooling arrangement that assists uniform coolant distribution, provides sufficient cooling through the middle portion of a film hole, and creates an internal medium flow vortex with an improved structure would be welcomed in the technology.

BRIEF DESCRIPTION OF THE INVENTION

Aspects and advantages of the invention will be set forth in part in the following description, or may be obvious from the description, or may be learned through practice of the invention.

In one embodiment, the present subject matter discloses an article with a thermal material having a first surface and a second surface. The thermal material defines a film hole between the first surface and the second surface, and the film hole includes a metering portion adjacent the first surface and a diffuser portion adjacent the second surface. The metering portion defines a metering hole axis, and the diffuser portion defines a trench. Also, the trench extends substantially parallel to a metering hole axis.

In another embodiment, the present subject matter discloses a turbine component with an airfoil having a first surface and second surface. The airfoil defines a film hole between the first surface and the second surface, and the film hole includes a metering portion and a diffuser portion. In addition, the metering portion defines a metering hole axis, and the diffuser portion defines a trench. Also, the trench extends substantially parallel to a metering hole axis.

In a further embodiment, a method of manufacturing a turbine component having a first surface and second surface is disclosed. The method may include forming a film hole between the first surface and the second surface where the film hole comprises a diffuser portion and a metering portion, and forming a trench on the diffuser portion, the trench extending substantially parallel to a metering hole axis, the metering hole axis being defined by the metering portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 illustrates a perspective view of the film hole shown in FIG. 2, particularly illustrating a trench defined in a diffuser portion of the film hole;

FIG. 4 illustrates a top cross-sectional view of the film hole shown in FIG. 2 taken along line 4-4, particularly illustrating the trench being substantially parallel to a metering hole axis.

FIG. 5 illustrates a perspective view of a diffuser portion of a film hole according to another embodiment, particularly illustrating a trench defined in the diffuser portion;

FIG. 6 illustrates a top cross-sectional view of a film hole according to a further embodiment, particularly illustrating multiple trenches defined in a diffuser portion of the film hole.

DETAILED DESCRIPTION OF THE INVENTION

Figure 1:
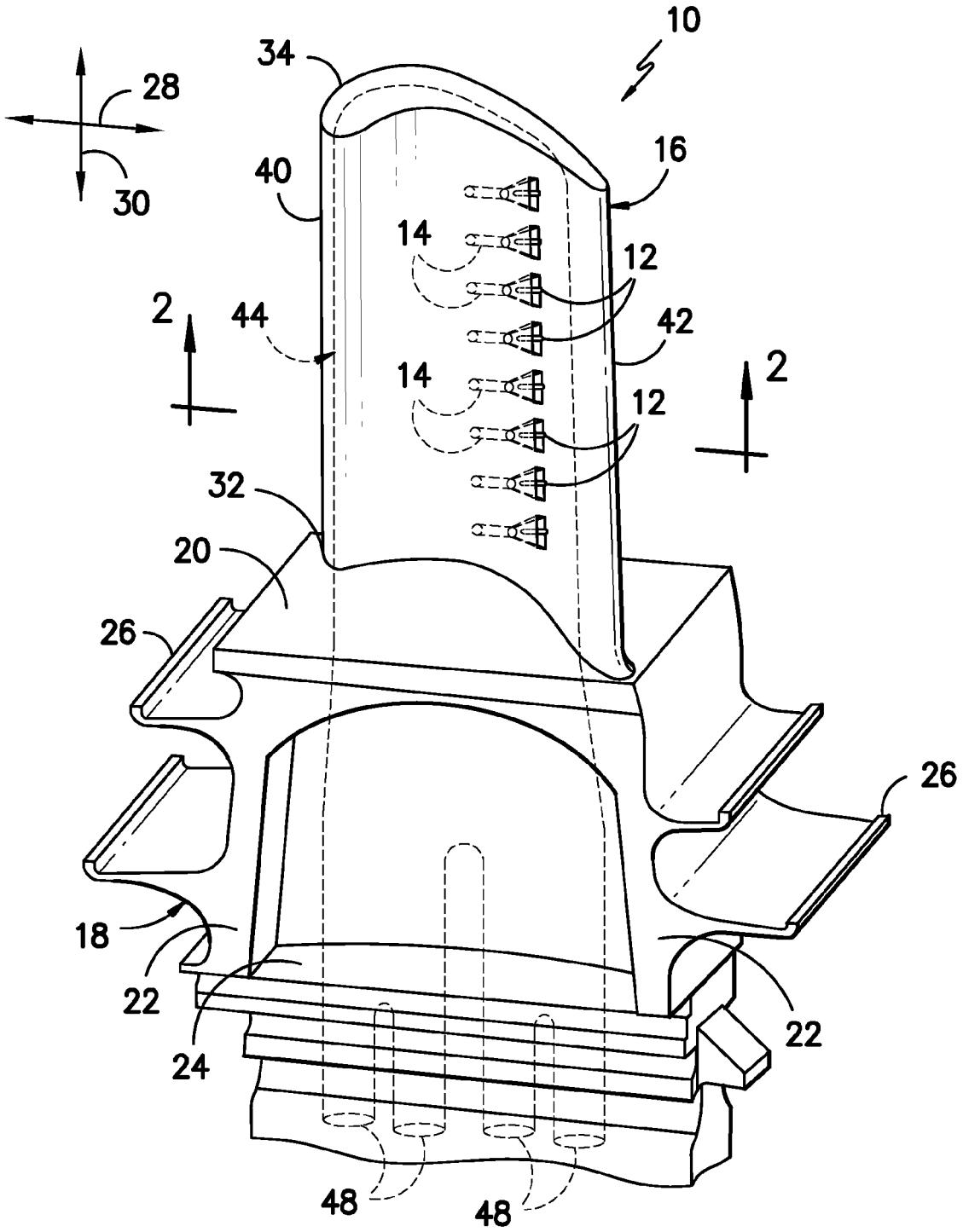
FIG. 1 illustrates a perspective view of one embodiment of a turbine bucket having film holes defined therein in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present subject matter is generally directed to a trench formed in a film hole. In particular, the present subject matter discloses a trench formed in a diffuser portion of a film hole of a turbine component. In several embodiments, the trench may be formed in the diffuser portion so as to be substantially parallel to a metering hole axis of the film hole. The use of a film hole with a trench that is substantially parallel to the metering hole axis of the film hole may assist in uniform spreading of a film of cooling medium across an airfoil surface and/or may assist in directing the cooling medium to a middle portion of the film hole, thereby enhancing the film cooling effectiveness, reducing cooling requirements and/or increasing component life and/or temperature capability.

In general, the trench of the present subject matter will be described herein with reference to a film hole of a turbine bucket of a gas turbine. However, it should be readily appreciated by those of ordinary skill in the art that the trench may generally be defined in any other suitable turbine component (e.g., turbine nozzles, stator vanes, compressor blades, combustion liner, transition pieces, exhaust nozzles and/or the like having film cooling holes). Additionally, it should be appreciated that application of the present subject matter need not be limited to turbine components. Specifically, the trench may generally be formed in any suitable film hole through which a cooling medium (e.g., water, steam, air and/or any other suitable fluid) is directed for cooling a surface of the article and/or for maintaining the temperature of a surface of the article.

Figure 2:
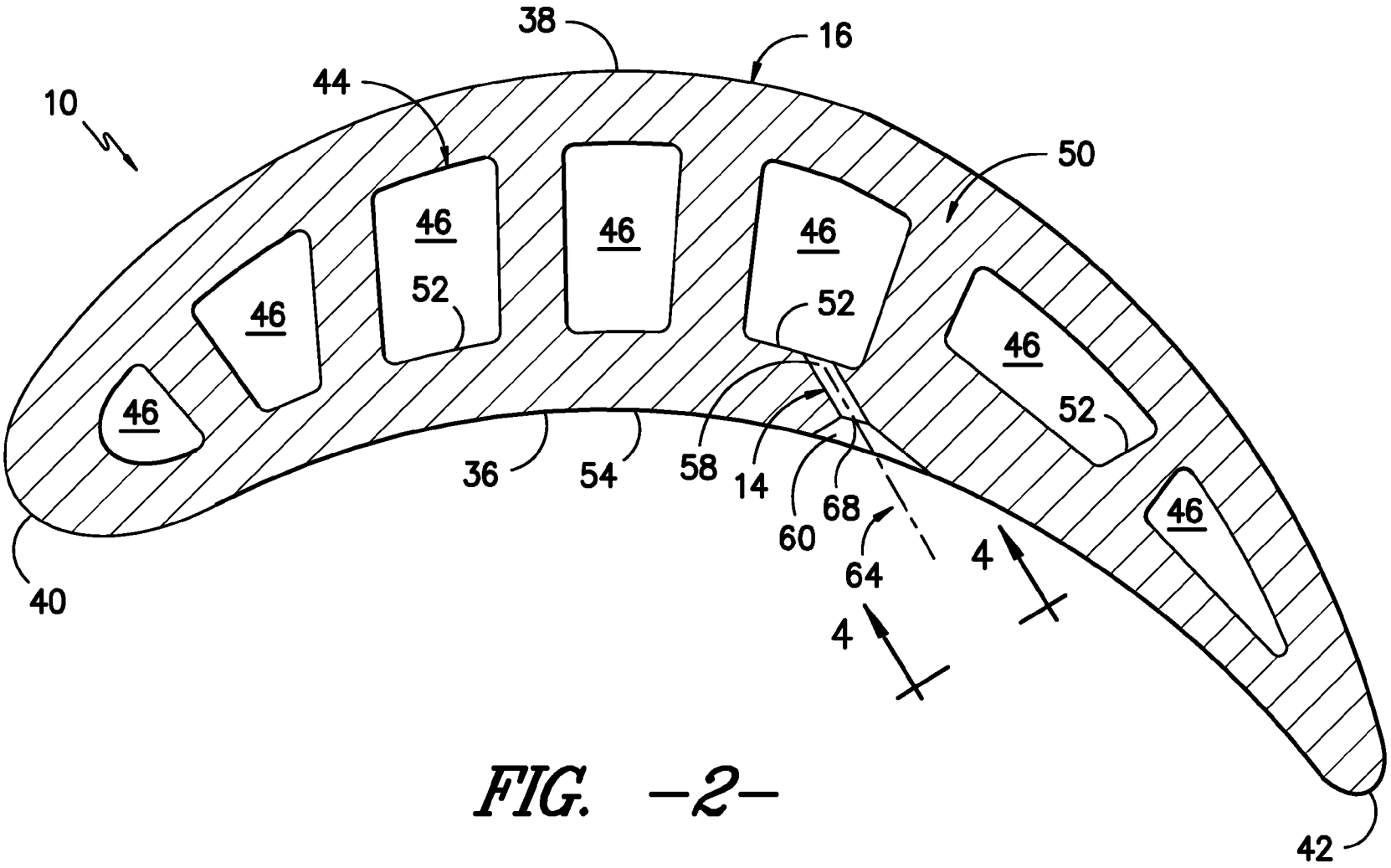
FIG. 2 illustrates a cross-sectional view of the turbine bucket shown in FIG. 1 taken along line 2-2.

Referring now to the drawings, FIGS. 1 and 2 illustrate one embodiment of a turbine bucket 10 having a plurality of film holes 14 with each particular film hole 14 including a trench 12 defined therein in accordance with aspects of the present subject matter. In particular, FIG. 1 illustrates a perspective view of the turbine bucket 10. FIG. 2 illustrates a cross-sectional view of a portion of an airfoil 16 of the turbine bucket 10 shown in FIG. 1 taken along line 2-2, particularly illustrating one of the film holes 14 shown in FIG. 1.

As shown, the turbine bucket 10 generally includes a shank portion 18 and an airfoil 16 extending from a substantially planar platform 20. The platform 20 generally serves as the radially inward boundary for the hot gases of combustion flowing through a turbine section of a gas turbine (not shown). The shank portion 18 of the bucket 10 may generally be configured to extend radially inwardly from the platform 20 and may include sides 22, a hollow cavity 24 partially defined by the sides 22 and one or more angel wings 26 extending in an axial direction (indicated by arrow 28) from each side 22. The shank portion 18 may also include a root structure (not illustrated), such as a dovetail, configured to secure the bucket 10 to a rotor disk of a gas turbine (not shown).

The airfoil 16 may generally extend outwardly in a radial direction (indicated by arrow 30) from the platform 20 and may include an airfoil base 32 disposed at the platform 20 and an airfoil tip 34 disposed opposite the airfoil base 32. Thus, the airfoil tip 34 may generally define the radially outermost portion of the turbine bucket 10. The airfoil 16 may also include a pressure side surface 36 and a suction side surface 38 (FIG. 2) extending between a leading edge 40 and a trailing edge 42. The pressure side surface 36 may generally comprise an aerodynamic, concave outer surface of the airfoil 16. Similarly, the suction side 48 may generally define an aerodynamic, convex outer surface of the airfoil 16.

Additionally, the turbine bucket 10 may also include an airfoil cooling circuit 44 extending radially outwardly from the shank portion 18 for flowing a medium, such as a cooling medium (e.g., air, water, steam or any other suitable fluid), throughout the airfoil 16. In general, it should be appreciated that the airfoil circuit 44 may have any suitable configuration known in the art. For example, in several embodiments, the airfoil circuit 44 may include a plurality of channels 46 (FIG. 2) extending radially outwardly from one or more supply passages 48 to an area of the airfoil 16 generally adjacent the airfoil tip 34. Specifically, as shown in FIG. 2, the airfoil circuit 44 includes seven radially extending channels 46 configured to flow the cooling medium supplied from the supply passages 48 throughout the airfoil 16. However, one of ordinary skill in the art should appreciate that the airfoil circuit 44 may include any number of channels 46.

Moreover, as particularly shown in FIG. 2, the airfoil 16 of the turbine bucket 10 may generally be formed from a substrate or thermal material 50 having a first or inner surface 52 and a second or outer surface 54. The first surface 52 may also be referred to as the "cool" surface while the second surface 54 may be referred to as the "hot" surface, since the second surface 54 is generally exposed to relatively higher temperatures than the first surface 52 during operation of a gas turbine (not shown). For example, as shown in the illustrated embodiment, the first surface 52 of the thermal material 50 may generally define all or part of the channels 46 of the airfoil circuit 44. As such, the cooling medium flowing through the channels 46 may provide direct cooling for such surface 52.

It should be appreciated that the thermal material 50 may generally comprise any suitable material capable of withstanding the desired operating conditions of the component and/or article being formed by the thermal material 50. For example, in embodiments in which the thermal material 50 forms part of a turbine component (e.g., the turbine bucket 10) suitable materials may include, but are not limited to, ceramics and metallic materials, such as steel, refractory metals, nickel-based superalloys, cobalt-based superalloys, iron-based superalloys and/or the like.

Referring still to FIGS. 1 and 2, as indicated above, the turbine bucket 10 may also include a film hole 14 defined in the airfoil 16. In general, the film hole 14 may be configured to supply a portion of the cooling medium flowing through the airfoil circuit 44 for cooling the pressure side surface 36 and/or the suction side surface 38 of the airfoil 16. Thus, in several embodiments, the film hole 14 may be in flow communication with a portion of the airfoil circuit 44 at one end and may be in flow communication with the second surface 54 at the other end. For example, as shown in the illustrated embodiment, the film hole 14 may extend within the airfoil 10 from the first surface 52 of the thermal material 50 (e.g., from one of the channels 46 of the airfoil circuit 44) to the pressure side surface 36 of the airfoil 16.

As shown in FIG. 2, the film hole 14 may include a metering portion 58, a diffusing or diffuser portion 60, and a threshold 68. In general, the metering portion 58 may be disposed adjacent the first surface 52. For example, as shown in FIG. 2, the metering portion 58 may extend from the first surface 52 to the threshold 68. In addition, the metering portion 58 may generally define a substantially constant cross-sectional area. For example, in the illustrated embodiments, the metering portion 58 defines a substantially constant circular cross-sectional shape between the first surface 52 and the threshold 68. However, in alternative embodiments, the metering portion 58 may have any other suitable cross-sectional shape (e.g., a rectangular or oval cross-sectional shape). In addition, in the illustrated embodiments, the metering portion 58 defines a substantially linear cooling medium pathway. In alternative embodiments, the metering portion may define a substantially orifice like, short, splined, ribbed, angled or curved cooling medium pathway, and may include any combination of the previously listed configurations (e.g., the metering portion 58 may include multiple linear, angled, and/or curved segments).

In addition, as shown in FIG. 2, the metering portion 58 may define a metering hole axis 64. As used herein, the term "metering hole axis" may correspond to an axis that extends substantially parallel to the flow of cooling medium exiting the metering portion 58 at the threshold 68. For example, as indicated above, in the illustrated embodiment, the metering portion 58 generally defines a substantially linear cooling medium pathway. As such, the metering hole axis 64 may extend substantially parallel to the metering portion 58 along its entire length. However, in embodiments in which the metering portion 58 defines a curved cooling medium pathway, the metering hole axis 64 may only extend parallel to the metering portion 58 at the point at which the metering portion 58 terminates at the threshold 68.

The threshold 68 of the film hole 14 may generally correspond to a transition point between the metering portion 58 and the diffuser portion 60. Thus, as shown in FIG. 2, the threshold 68 may be defined at the interface between the metering portion 58 and the diffuser portion 60 such that cooling medium exiting the metering portion 58 enters the diffuser portion 60 at the threshold 68.

Additionally, the diffuser portion 60 of the film hole may generally be disposed adjacent the second surface 54. For example, as shown in FIG. 2, the diffuser portion 60 may extend from the second surface 54 to the threshold 68. Accordingly, as may be seen in FIG. 2, a cooling medium supplied through the airfoil circuit 44 may enter the metering portion 58 of the film hole 14 at the first surface 52 and flow through the threshold 68 and into the diffuser portion 60 of the film hole 14. The diffuser portion 60 may generally be configured to diverge outwardly from the metering portion 58 and threshold 68 towards the second surface 54. Accordingly, the cooling medium directed through the metering portion 58 and into the diffuser portion 60 may expand outwardly as it flows out of the metering portion 58. In particular, the diffuser portion 60 may permit the cooling medium to expand in the radial or longitudinal direction, thereby reducing the velocity and increasing the pressure of the cooling medium. Such reduced velocity may generally enhance flow attachment against the surface of the airfoil 16 (e.g., the pressure side surface 36) as the cooling medium exits the diffuser portion 60.

Referring now to FIGS. 3 and 4, in several embodiments, a trench 12 may be defined at least partially in the diffuser portion 60 of the film hole 14. In general, the trench 12 may be defined at any suitable location in the diffuser portion 60. For example, as shown in the illustrated embodiment, the trench 12 is defined in a downstream wall 90 of the diffuser portion 60 (e.g., the wall of the diffuser portion 60 extending from the threshold 68 generally in the direction of the flow of gases across the second surface 54). However, in other embodiments, the trench 12 may be defined at any other suitable location in the diffuser portion 60, such as in a sidewall 94 of the diffuser portion 60 or an upstream wall 92 of the diffuser portion 60.

Additionally, the trench 12 may generally define any suitable shape. For example, as shown in FIG. 3, the trench 12 may define a semi-conical shape. However, in alternative embodiments, the trench may define any other suitable shape such as a rectangular prism, a pyramid, or a half-cylinder shape.

As shown in FIG. 3, the trench 12 may have a top or first end 70 and a bottom or second end 72. Also, as shown in FIG. 3, a width of the second end 72 (e.g., a second end width 84) may be greater than a width of the first end 70 (e.g., a first end width 82), and, thus, the trench 12 may be tapered from the second end 72 to the first end 70. In alternative embodiments, the first end width 82 and the second end width 84 may be substantially equal, or the first end width 82 may be greater than the second end width 84. However, in general, it should be appreciated that the first end width 82 may be any suitable percentage of the second end width 84 such as 25%, 50%, 75%, 125%, 150%, 200%, or 300% of the second end width 84.

Additionally, the trench 12 may generally define a length 86 between its first and second ends 70,72 that extends along a fraction or an entire length of the diffuser portion 60. For example, as shown in FIG. 3, the trench 12 may extend along the entire length of the diffuser portion 60 such that the second end 72 of the trench 12 is disposed adjacent to an edge 66 of the diffuser portion 60 (e.g., the edge of the downstream wall 90 of the diffuser portion 60 defined at the second surface 54), and the first end 70 of the trench 12 is disposed adjacent to the threshold 68. In alternative embodiments, the trench 12 may extend beyond the edge and into the second surface 54 such that the second end 72 of the trench 12 is disposed on the second surface 54. For example, in particular embodiments, any suitable portion of the length 86 of the trench 12 (e.g., 5%, 10%, 25%, or 50% of the length 86 of the trench 12) may extend beyond the edge of the diffuser portion 60 such that the second end 72 of the trench 12 is disposed on the second surface 54.

In addition, as shown in FIG. 3, in one embodiment, the second end width 84 of the trench 12 may comprise about 10% of a width of the edge 66 (e.g., an edge width 74). In alternative embodiments, the second end width 72 may be any suitable percentage of the edge width 74 (e.g., about 25%, 50%, 75%, or 99% of the edge width 74).

Moreover, the diffuser portion 60 of the film hole 14 may define a profile on the second surface 54. For example, as shown in FIG. 3, the diffuser portion 60 may define a trapezoidal profile on the second surface 54. However, in other embodiments, the diffuser portion may define any other suitable profile on the second surface 54, such as a rectangle, a chevron, a bell, a hood, a circle, an oval, a parallelogram, or a triangle.

As particularly shown in FIG. 4, in several embodiments, the trench 12 may be defined in the diffuser portion 60 such that the trench 12 extends substantially parallel to the metering hole axis 64. By the trench 12 extending substantially parallel to the metering hole axis 64, it is meant that the trench 12 extends lengthwise (e.g., from its first end 70 to its second end 72) substantially parallel to the metering hole axis 64 from at least one perspective of a series of perspectives of the metering hole axis 64 taken about the metering hole axis 64. For example, FIG. 4 illustrates a perspective view of the film hole 12 looking down onto the downstream wall 90 of the diffuser portion 60. As shown, the trench 12 generally extends between its first and second ends 70,72 in a direction that is substantially parallel to the metering hole axis 64.

As shown in FIG. 4, in particular embodiments, the trench 12 may be substantially equidistant from a first sidewall 76 and a second sidewall 78 of the diffuser portion 60. In alternative embodiments, the trench may be a different distance from the first sidewall 76 and the second side wall 78. For example, the distance between the trench 12 and the first sidewall 76 may be about 25%, 50%, or 75% of distance between the trench 12 and the second sidewall 78 or vice versa.

In addition, as shown in FIG. 5, the first end 70 of the trench 12 may be downstream or upstream of the threshold 68. In the embodiment shown in FIG. 5, the length 86 of the trench 12 is about 75% of a length of the diffuser portion 60 between the threshold 68 and the diffuser edge 66 (e.g., the overall diffuser portion length 88). In alternative embodiments, the second end 72 of the trench 12 may be downstream of the threshold 68, relative to the flow of cooling medium, such that the length 86 of the trench 12 is less than or equal to about 10%, 25%, 50%, 90%, 100%, 125%, 150% or more of the overall diffuser portion length 88. In additional alternative embodiments, the first end 70 of the trench 12 may be upstream of the threshold 68 such that the first end 70 of the trench 12 is disposed on the metering portion 58. In addition, in particular embodiments, the first end 70 of the trench 12 may be disposed on the metering portion 58, and the second end 72 of the trench 12 may be disposed on the second surface 54 such that the trench 12 extends from the metering portion 58 onto the second surface 54. Also, a length 86 of the trench 12 may be greater than or less than a length of the diffuser portion 60 (e.g., the overall diffuser portion length 88).

In particular embodiments, the trench 12 may define an angle relative to the metering hole axis 64. For example, the trench 12, extending lengthwise from the first end 70 to the second end 72, may define the angle relative to the metering hole axis 64 such that the angle is substantially equal to an angle of the diffuser portion 60 relative to the metering hole axis 64. In alternative embodiments, the angle may be greater than or less than the angle of the diffuser portion 60.

Referring now to FIG. 6, in other embodiments, the diffuser portion 60 may define at least one additional trench 80 (e.g., one, two, three, or more additional trenches). The at least one additional trench 80 may generally comprise any of the trench 12 embodiments described above. As shown in FIG. 6, the trench 12 and the at least one additional trench 80 may generally extend substantially parallel to the metering hole axis 64 and may be substantially uniformly distributed about the metering hole axis 64. In alternative embodiments, the trench 12 and the at least one additional trench 80 may be distributed about the metering hole axis 64 in any suitable manner. In additional alternative embodiments, the trench 12 and at least one additional trench 80 may have different widths, lengths, and shapes.

It should be appreciated that the present subject matter is also directed to a method for making a turbine component or any other article having a first surface 52 and a second surface 54. The method may generally include forming a film hole 14 between the first surface 52 and the second surface 54 and forming a trench 12 in a diffuser portion 60 of the film hole 14.

The film hole 14 may be formed using various known machining processes, such as by using a laser machining process, an EDM process, a water jet machining process, a milling process and/or any other suitable machining process or combination of machining processes. Additionally, in one embodiment, the metering portion 60 of the film hole 14 may be formed in a separate manufacturing step from the diffuser portion 60 of the film hole 14. For example, the metering portion 58 may be initially formed within the thermal material 50 with the diffuser portion 60 being subsequently machined therein or vice versa. Alternatively, the metering portion 58 and the diffuser portion 60 may be formed together in a single manufacturing step. For instance, a shaped electrode may be utilized in an EDM process to simultaneously form both the metering portion 58 and the diffuser portion 60 of the film hole 14.

In general, the trench 12 of the present subject matter may be formed by removing portions of thermal material 50 using various known machining processes. For example, in one embodiment, a laser machining process may be used to form the trench 12. In another embodiment, the trench 12 may be formed using an electrical discharge machining ("EDM") process, a water jet machining process (e.g., by using an abrasive water jet process) and/or a milling process. Alternatively, any other suitable machining process known in the art for removing selected portions of material from an object may be utilized to form the trench 12. Additionally, it should be appreciated that, in one embodiment, the film hole 14 may be formed with the trench 12 in a single manufacturing step. For example, an electrode may be utilized in an EDM process to form the film hole 14 without the trench 12 or the film hole 14 with the trench 12.

In addition to the steps described above, the method for making a turbine component may further include forming at least one additional trench 80 on the diffuser portion 60. The at least one additional trench 80 may be substantially parallel to the metering hole axis 58. The at least one additional trench 80 may be formed in the same manner as the trench 12 described above.

As indicated above, it should be readily appreciated that the disclosed trench 12 and film holes 14 need not be limited to use within turbine buckets and/or turbine components. Rather, the present subject matter may generally be applied within any suitable article through which a cooling medium (e.g., water, steam, air and/or any other suitable fluid) is directed for cooling a surface of the article and/or for maintaining the temperature of a surface of the article. For instance, the first surface 52 of the thermal material 50 described above may generally comprise any suitable surface of an article that is in flow communication with a cooling medium source (e.g., a water source, steam source, air source and/or any other suitable fluid source) such that the cooling medium derived from such source may be directed through the film holes 14 and trench 12 and onto a differing surface of the article.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An article comprising:

a thermal material having a first surface and second surface;

a film hole defined in said thermal material between said first surface and said second surface, said film hole including a metering portion adjacent said first surface and a diffuser portion adjacent said second surface, said metering portion defining a metering hole axis; and a trench defined in said diffuser portion, said trench extending substantially parallel to said metering hole axis, said trench positioned at a middle portion of a downstream wall of said film hole and open to air flow within said film hole.

2. The article of claim 1, wherein said diffuser portion defines a profile on said second surface, said profile being one of a chevron, a trapezoid, a rectangle, a triangle, a hood, or a bell.

3. The article of claim 1, further comprising at least one additional trench defined in said diffuser portion, said at least one additional trench extending substantially parallel to said metering hole axis.

4. The article of claim 1, further comprising a threshold between said metering portion and said diffuser portion, and wherein said trench extends between a first end and a second end.

5. The article of claim 4, wherein said first end is adjacent said threshold, and said second end is adjacent a diffuser edge.

6. The article of claim 4, wherein a width of said second end is less than about 50% of a width of a diffuser edge.

7. The article of claim 4, wherein a width of said second end is more than about 50% of a width of a diffuser edge.

8. The article of claim 1, wherein a length of said trench is either greater or less than a length of a diffuser portion.

9. The article of claim 1, wherein said trench extends between a first end and a second end, said second end being wider than said first end.

10. A turbine component comprising:

an airfoil, said airfoil having a first surface and a second surface;

a film hole defined in said airfoil between said first surface and said second surface, said film hole having a metering portion and a diffuser portion, and said metering portion defining a metering hole axis; and a trench defined in said diffuser portion, said trench extending substantially parallel to a metering hole axis, said trench positioned at a middle portion of a downstream wall of said film hole and open to air flow within said film hole.

11. The turbine component of claim 10, wherein said diffuser portion defines a profile on said second surface, said profile being one of a chevron, a trapezoid, a rectangle, a triangle, a hood, or a bell.

12. The turbine component of claim 10, further comprising at least one additional trench defined in said diffuser portion, said at least one additional trench extending substantially parallel to said metering hole axis.

13. The turbine component of claim 10, further comprising a threshold between said metering portion and said diffuser portion, and wherein said trench extends between a first end and a second end.

14. The turbine component of claim 13, wherein said first end is adjacent said threshold, and said second end is adjacent a diffuser edge.

15. The turbine component of claim 14, wherein a width of said second end is more than about 50% of a width of a diffuser edge.

16. The turbine component of claim 13, wherein a width of said second end is less than about 50% of a width of a diffuser edge.

17. The turbine component of claim 10, wherein a length of said trench is either greater or less than a length of said diffuser portion.

18. The turbine component of claim 10, wherein said trench extends between a first end and a second end, said second end being wider than said first end.

19. A method of manufacturing a turbine component having a first surface and second surface comprising:

forming a film hole between said first surface and said second surface, said film hole having a diffuser portion and a metering portion defining a metering hole axis; and forming a trench in said diffuser portion such that said trench is substantially parallel to said metering hole axis and is positioned at a middle portion of a downstream wall of said film hole, the trench open to air flow within said film hole.

20. The method of claim 19, further comprising forming at least one additional trench in said diffuser portion such that said at least one additional trench is substantially parallel to said metering hole axis.

* * * * *